US010302395B1

(12) United States Patent
Holland

(10) Patent No.: US 10,302,395 B1
(45) Date of Patent: May 28, 2019

(54) QUICK AIM RETICLE

(71) Applicant: Darrell Holland, Powers, OR (US)

(72) Inventor: Darrell Holland, Powers, OR (US)

( * ) Notice: Subject to any disclaimer, the term of this patent is extended or adjusted under 35 U.S.C. 154(b) by 0 days.

(21) Appl. No.: 15/950,464

(22) Filed: Apr. 11, 2018

(51) Int. Cl.
*F41G 1/38* (2006.01)

(52) U.S. Cl.
CPC ..... *F41G 1/38* (2013.01)

(58) Field of Classification Search
CPC ... F41G 1/38; F41G 1/473; F41G 3/06; G02B 27/32; G02B 23/14
USPC ..... 42/122, 130; 356/21; 89/41.17
See application file for complete search history.

(56) References Cited

U.S. PATENT DOCUMENTS 1,190,121 A 7/1916 Critchett
3,190,003 A 6/1965 O'Brien
3,392,450 A 7/1968 Herter et al.
3,744,133 A 7/1973 Fukushima et al.
3,782,822 A 1/1974 Spence et al.
3,826,012 A 7/1974 Pachmayr
3,862,012 A 1/1975 Stork
3,948,587 A 4/1976 Rubbert
3,990,155 A 11/1976 Akin et al.
4,263,719 A 4/1981 Murdoch
4,389,791 A 6/1983 Ackerman
5,491,546 A 2/1996 Wascher
5,499,455 A 3/1996 Palmer
5,920,995 A 7/1999 Sammut
5,960,576 A 10/1999 Robinson
6,357,158 B1 3/2002 Smith
6,453,595 B1 9/2002 Sammut
6,516,551 B2 2/2003 Gaber
6,516,699 B2 2/2003 Sammut et al.
6,591,537 B2 7/2003 Smith
6,609,325 B2 8/2003 Harris
6,681,512 B2 1/2004 Sammut
6,729,062 B2 5/2004 Thomas
6,772,550 B1 8/2004 Leatherwood
7,738,082 B1 * 6/2010 Peters ..... G01C 3/22 356/4.01
7,856,750 B2 12/2010 Sammut et al.
7,926,408 B1 * 4/2011 Kley ..... F41A 33/02 124/73
8,109,029 B1 2/2012 Sammut et al.
8,353,454 B2 * 1/2013 Sammut ..... F41G 1/38 235/404
8,910,412 B2 * 12/2014 Mikroulis ..... F41G 1/473 42/122

(Continued)

*Primary Examiner* — Michael D David
(74) *Attorney, Agent, or Firm* — Timothy E. Siegel Patent Law, PLLC; Timothy E. Siegel

(57) ABSTRACT

An assembly includes a rifle and a rifle scope housing, defining an eyepiece. An optical train includes a reticle. When a user looks through the eyepiece, a display is presented having a set of first horizontal lines, each marked by an indicium and a set of second horizontal lines, each marked by an indicium. A pair formed of a first and a second horizontal line is spaced apart by a distance that fits an adult black-tail buck from back to the brisket if the buck is at a range that results in a bullet drop. The first horizontal lines is labeled with a first indicium. Also, a set of marks includes a first mark which will, if placed on a target, result in an elevation angle, relative to the target, that will compensate for the bullet drop, and wherein the first mark is also marked with the indicium.

20 Claims, 7 Drawing Sheets

(56) References Cited

U.S. PATENT DOCUMENTS

| | | | | |
|---|---|---|---|---|
| 8,959,824 | B2 * | 2/2015 | Sammut | F41G 1/38 42/122 |
| 8,966,806 | B2 | 3/2015 | Sammut et al. | |
| 9,068,799 | B1 * | 6/2015 | Wu | F41G 1/473 |
| 9,297,615 | B2 * | 3/2016 | Meinert | F41G 1/387 |
| 9,335,123 | B2 | 5/2016 | Sammut | |
| 2003/0145505 | A1 | 8/2003 | Kenton | |
| 2005/0229468 | A1 | 10/2005 | Zederey | |
| 2012/0046100 | A1 * | 2/2012 | Roman | F41G 1/467 463/30 |
| 2014/0370993 | A1 * | 12/2014 | Roman | F41G 1/467 463/51 |
| 2015/0034722 | A1 * | 2/2015 | Roman | F41G 3/06 235/404 |
| 2015/0233675 | A1 * | 8/2015 | Roman | F41G 1/467 235/407 |
| 2015/0241172 | A1 * | 8/2015 | Roman | F41G 1/473 235/404 |
| 2016/0069643 | A1 * | 3/2016 | Lyren | G09B 19/0038 345/589 |
| 2016/0084617 | A1 * | 3/2016 | Lyren | F41G 3/08 42/135 |

* cited by examiner

QUICK AIM RETICLE

BACKGROUND

Hunting for deer requires quick decision making. Time required to make calculations can be time that a deer uses to move on to more inviting forage, leaving the hunter's field of view. Accordingly, a system that can be used in a brief moment, and without needing to take one's eye from a scope eyepiece, is advantageous.

Also, increasingly common timed shooting competitions require participants to navigate a course, while shooting at targets, some of which are human shaped. If a participant uses a laser range finder, the time to read the laser range finder and adjust the elevation knob accordingly is time lost in negotiating the course. A faster way of ranging and aiming would provide a competitor with an advantage, in finishing the course quickly.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

A rifle and rifle scope assembly include a rifle and a rifle scope housing, attached to the rifle, the housing defining an eyepiece. An optical train is in the housing and a reticle lens is in the optical train. When a user looks through the eyepiece, the reticle lens presents a display having a set of first horizontal lines, each marked by an indicium and a set of second horizontal lines, each marked by an indicium. A first one of the first horizontal lines and a first one of the second horizontal lines form a first pair of lines, spaced apart by a distance that fits the distance on an adult black-tail buck from the top of the back to the brisket, as seen through the scope, if the buck is at a range that results in bullet drop of a first known amount. Also, the first one of the first horizontal lines is labeled with a first indicium and the first one of the second horizontal lines is marked with a second indicium indicating an aspect of an adult black-tail buck. Also, a set of marks includes a first mark which will, if placed on a target, result in an elevation angle, relative to the target, that will compensate for the first known amount of bullet drop, and wherein the first mark is also marked with the first indicium. Using this assembly, a user can determine that an adult black-tail buck fits the first pair of lines, from back to brisket, read the first indicium, find a mark marked with the first indicium, position the rifle so that when the user views the buck through the eyepiece, the mark is superimposed on the buck, and shoot, thereby quickly compensating for bullet drop at range to the buck.

In addition to the exemplary aspects and embodiments described above, further aspects and embodiments will become apparent by reference to the drawings and by study of the following detailed descriptions.

BRIEF DESCRIPTION OF THE DRAWINGS

Exemplary embodiments are illustrated in referenced drawings. It is intended that the embodiments and figures disclosed herein are to be considered illustrative rather than restrictive.

DETAILED DESCRIPTION OF THE PREFERRED EMBODIMENTS

Figure 1:
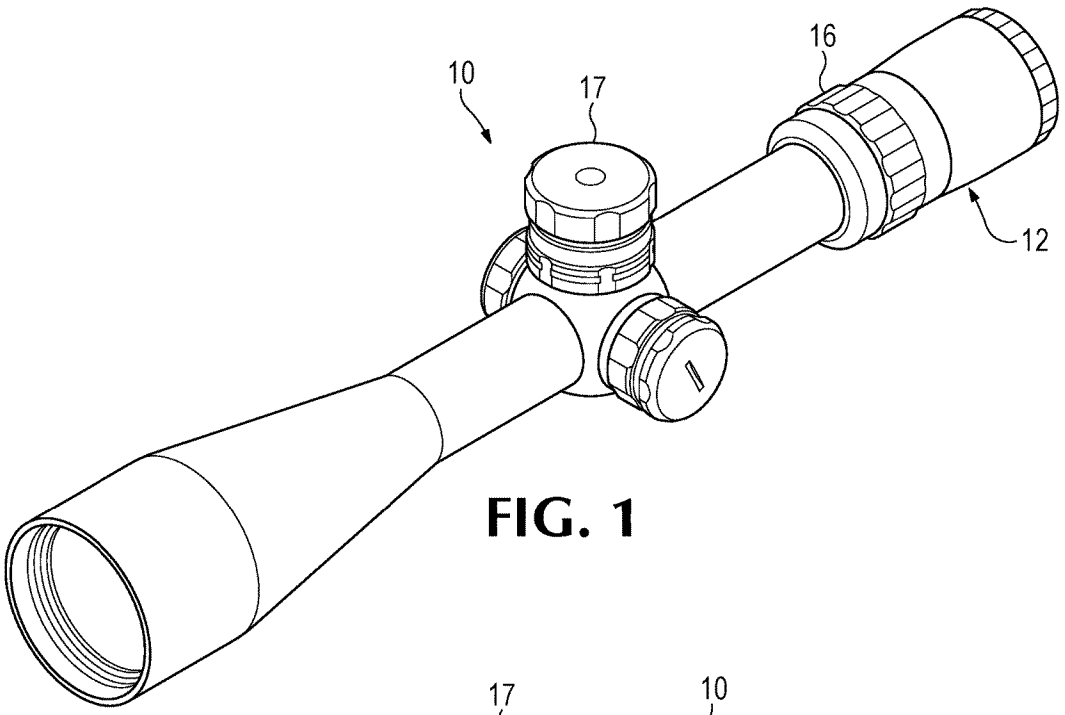
FIG. 1 is an isometric view of a rifle scope according to the present invention.
Figure 2:
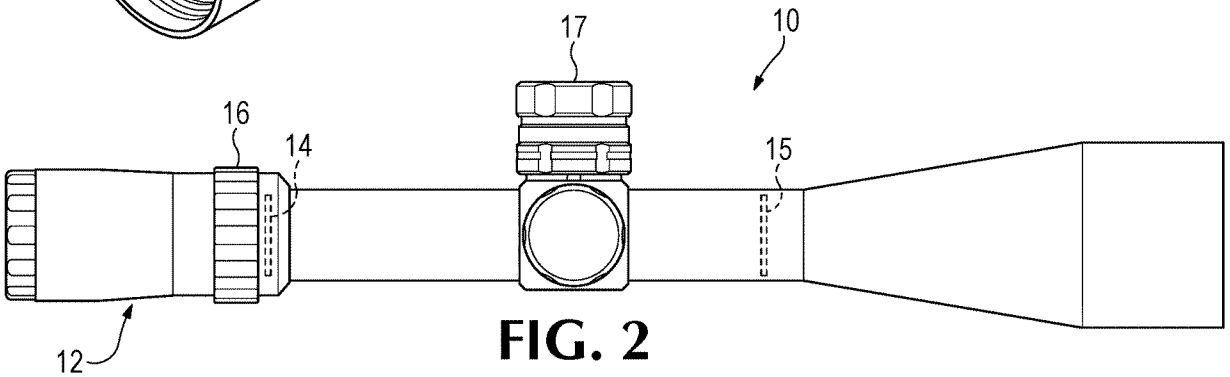
FIG. 2 is a side view of the rifle scope of FIG. 1.

Referring to FIGS. 1 and 2, a rifle scope 10, according to a preferred embodiment of the present invention, includes an eyepiece 12, a reticle lens 14, positioned in the second focal plane, and a zoom selector or power ring 16. In embodiments, scope 10 is attached to a rifle by a well-known method, such as by way of a Picatinny rail, to form a scope and rifle assembly (not shown). In an alternative embodiment the reticle lens is positioned in the first focal plane 15. An elevation knob 17 permits adjustment of the elevation of the reticle marks as seen by a user, versus the actual pointing direction of the scope 10 (and thereby the attached rifle).

Figure 3:
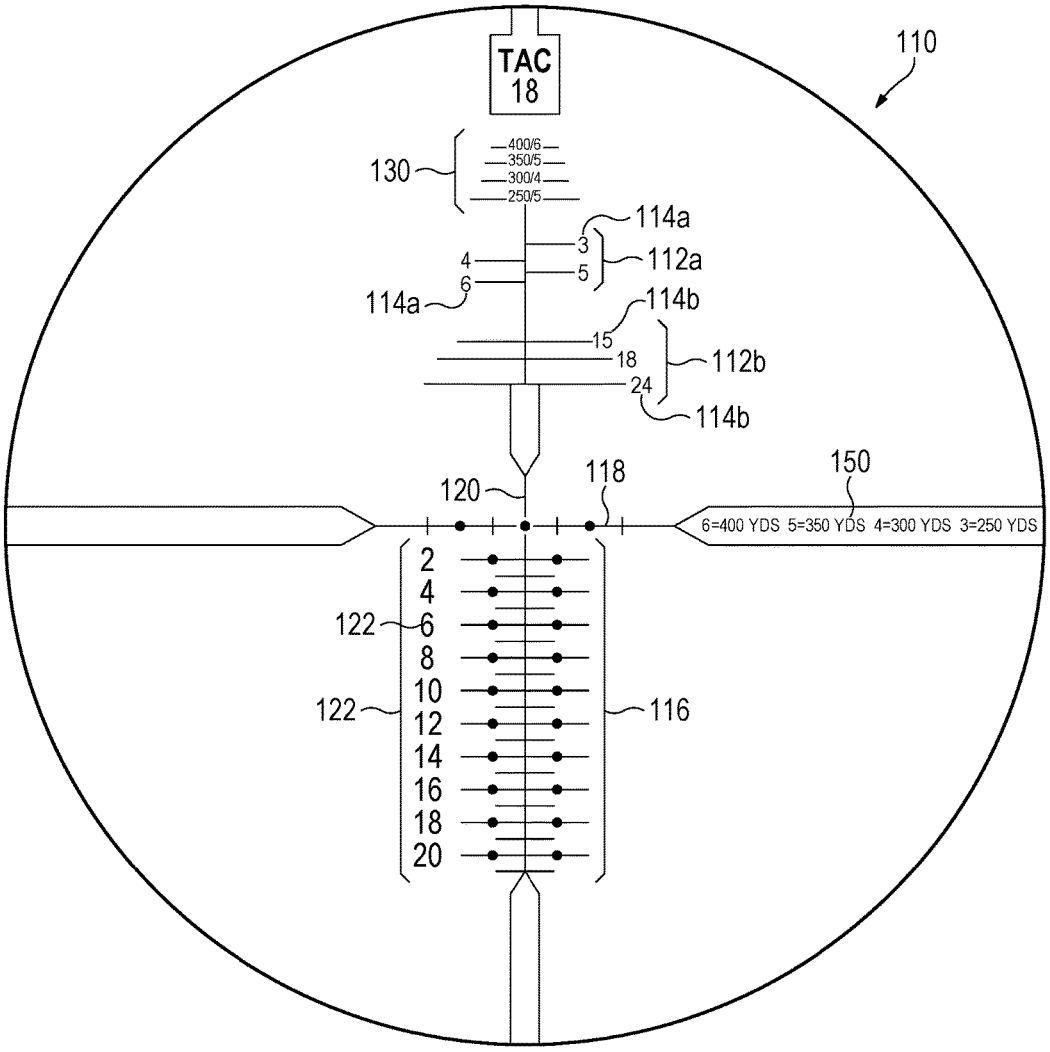
FIG. 3 is a reticle as seen through the scope of FIG. 1.

Referring to FIG. 3, a hunter viewing through the rifle scope 10 (attached to a rifle to form an assembly of rifle and scope) sees the reticle design 110 shown. For the embodiment in which the reticle lens is positioned in the second focal plane, the markings shown correspond to the highest level of scope magnification. The hunter may line up a target of known height, so that it is between, or subtends, a pair of lines, with a first line of the pair selected from a set of first lines 112*a*, and the second line of the pair selected from a set of second lines 112*b*, with both sets situated in the upper portion of the field of view. The set of first lines 112*a* are each marked with an indicium 114*a*, and the set of second lines 112*b* are each marked with an indicium 114*b*.

Figure 4A:
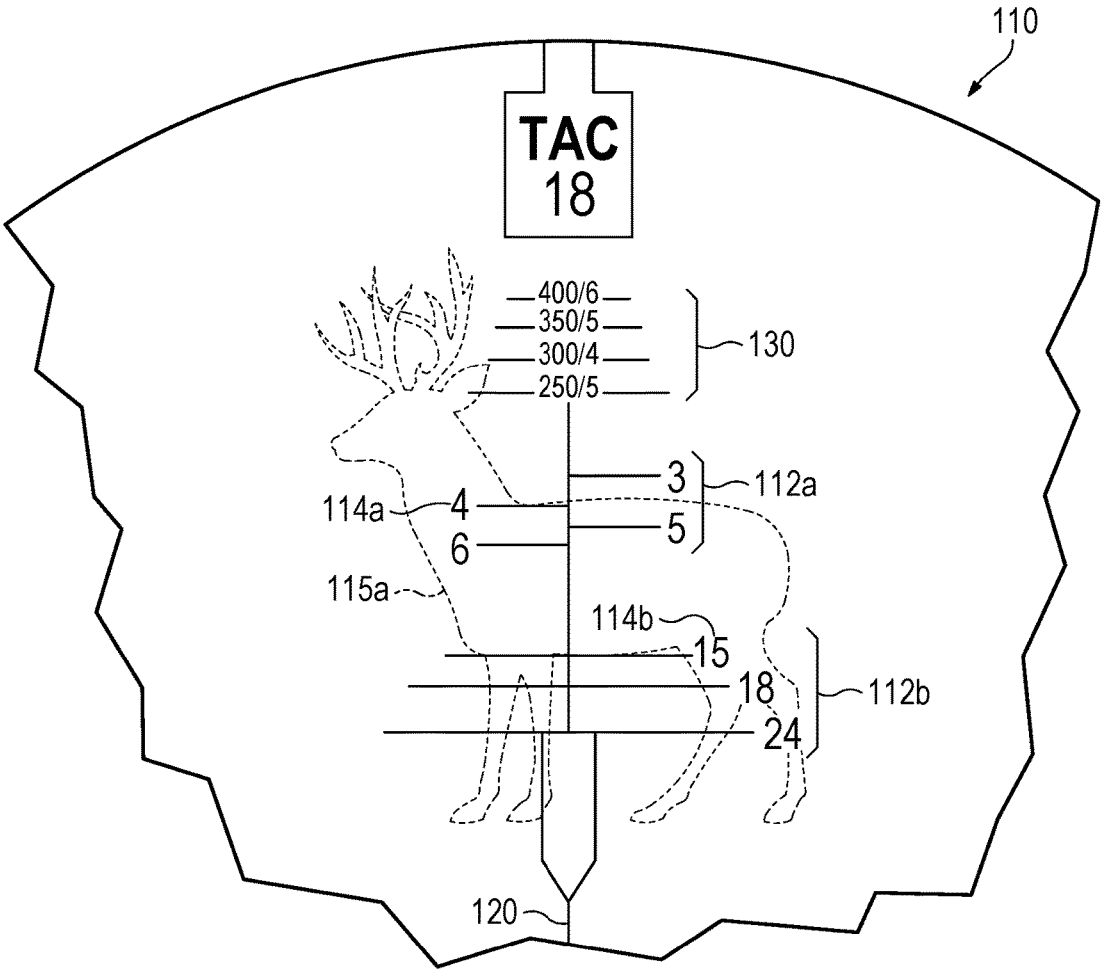
FIG. 4*a* is a view of a black tail buck at 300 yards, on the reticle of FIG. 3.
Figure 4B:
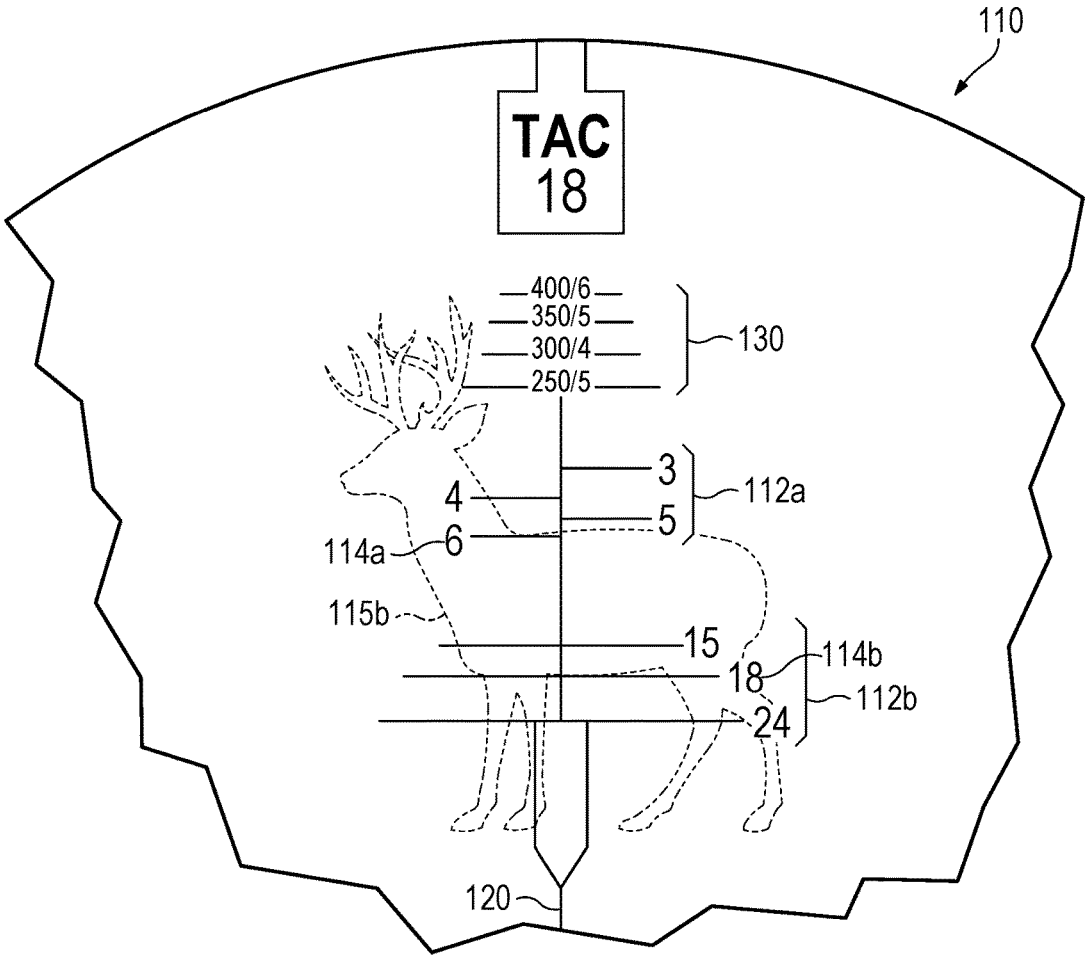
FIG. 4*b* is a view of a mule deer buck at 400 yards, on the reticle of FIG. 3.

In use of the scope 10 having reticle design 110, a shooter chooses a line from the set of second lines 112*b* based on pre-knowledge of the vertical height of the target. For example, it is well known that an adult Black Tail Deer measures 15" from back to brisket (the bottom of the rib cage), as does an Antelope, a Coues Deer and a Texas White Tail Deer. Accordingly, if the shooter were taking aim at one of those creatures, he would choose the second line 112*b* that is marked with a "15" indicium 114*b*. Then, he determines which one of the first lines 112*a* forms a pair with the selected second line 112*b* that brackets the buck from back to brisket (the bottom of the rib cage). FIG. 4*a* shows a Black Tail Buck 115*a* at 300 yards, subtending the pair of lines formed by the line 112*b* marked with a "15" indicium 114*b* and the line 112*a* marked with the "4" indicium 114*a*, indicating that 4 minutes of angle are required to compensate for bullet drop to the target, which is at about 300 yards. In FIG. 4*b* a Mule Deer Buck 115*b* is shown subtending the pair of lines formed by the line 112*b* marked with an "18" indicium 114*b* and the line 112*a* marked with a "6" indicium 114*a*. The indicia 114*a* and 114*b*, each reflect a target measurement made from the top of a second line 112*b* to the bottom of a first line 112*a*, as opposed to a measurement from the center of a second line 112*b* to a center of a first line 112*a*. With this innovation none of the target is blocked by either line 112*a* or 112*b*, both of which have some finite width, which would otherwise introduce uncertainty to the process of fitting a target to a pair of lines.

Notably, the reticle design shown also permits aiming at a mule deer, using a line selected from the second set of lines 112*b*, and marked at "18" by the indicium 114*b*, reflecting the 18" distance from the back of a mule deer to the bottom of the brisket. Similarly, the second lines also permit ranging a cow elk, by using the line marked with indicium 114*b* as "24," reflecting the distance in inches from the back to the brisket of an adult cow elk.

Figure 4C:
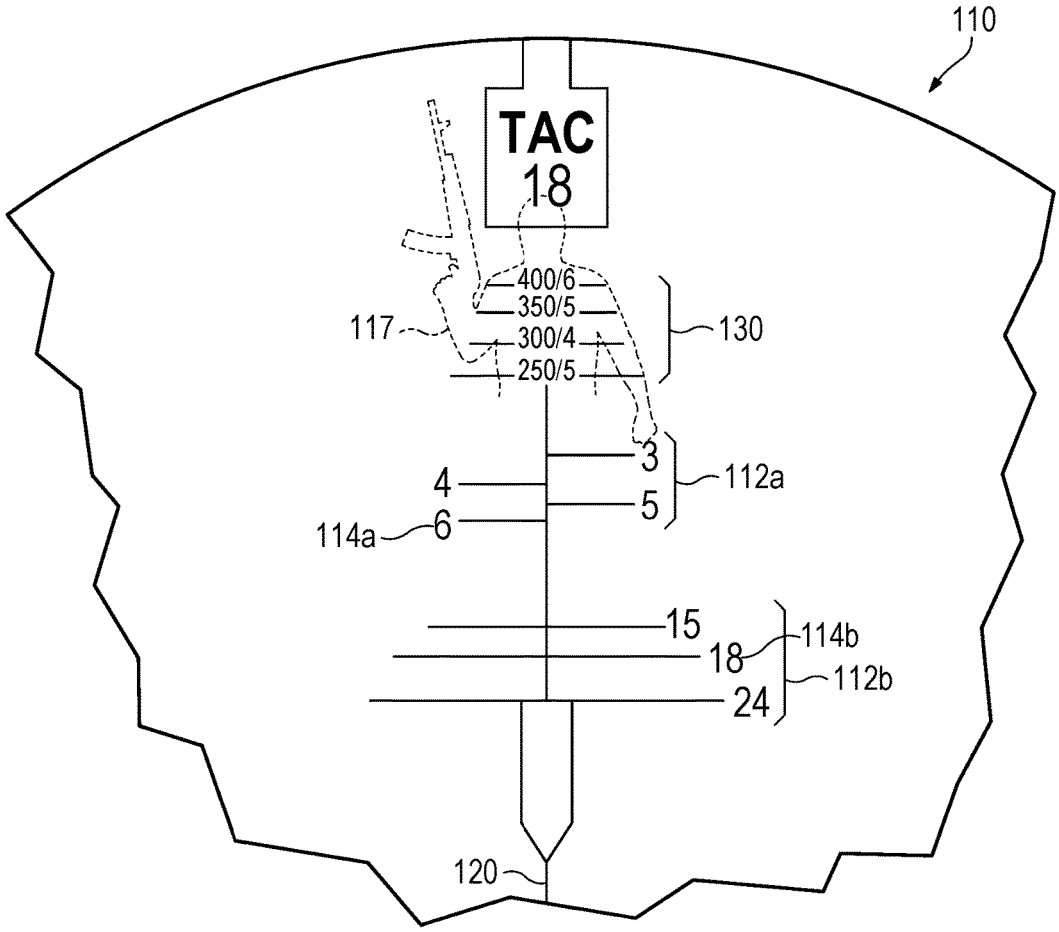
FIG. 4*c* is a view of a human figure at 400 yards.

A set of third lines 130, are provided for quickly measuring the range to a target that is 18" in width, such as a man shaped target that may be present in a shooting competition. This is indicated by the "TAC 18" icon at the very top of the reticle pattern. Third lines 130 are each marked by the range in yards to an 18" width target that fits the line width, and the minutes of angle of bullet drop that will occur over that range, in a format of "range/bullet drop". To use lines 130 a shooter determines which line best fits the 18" width target and reads the bullet drop indicium in the middle of the line 130 that best fits the shoulder width. FIG. 4*c* shows lines 130 being used to range a man 117, or a man-shaped target, as is often used in shooting contests. A man is typically 18 inches across at the back, with the top line of lines 130 indicating that the figure is at 400 yards.

Figure 4D:
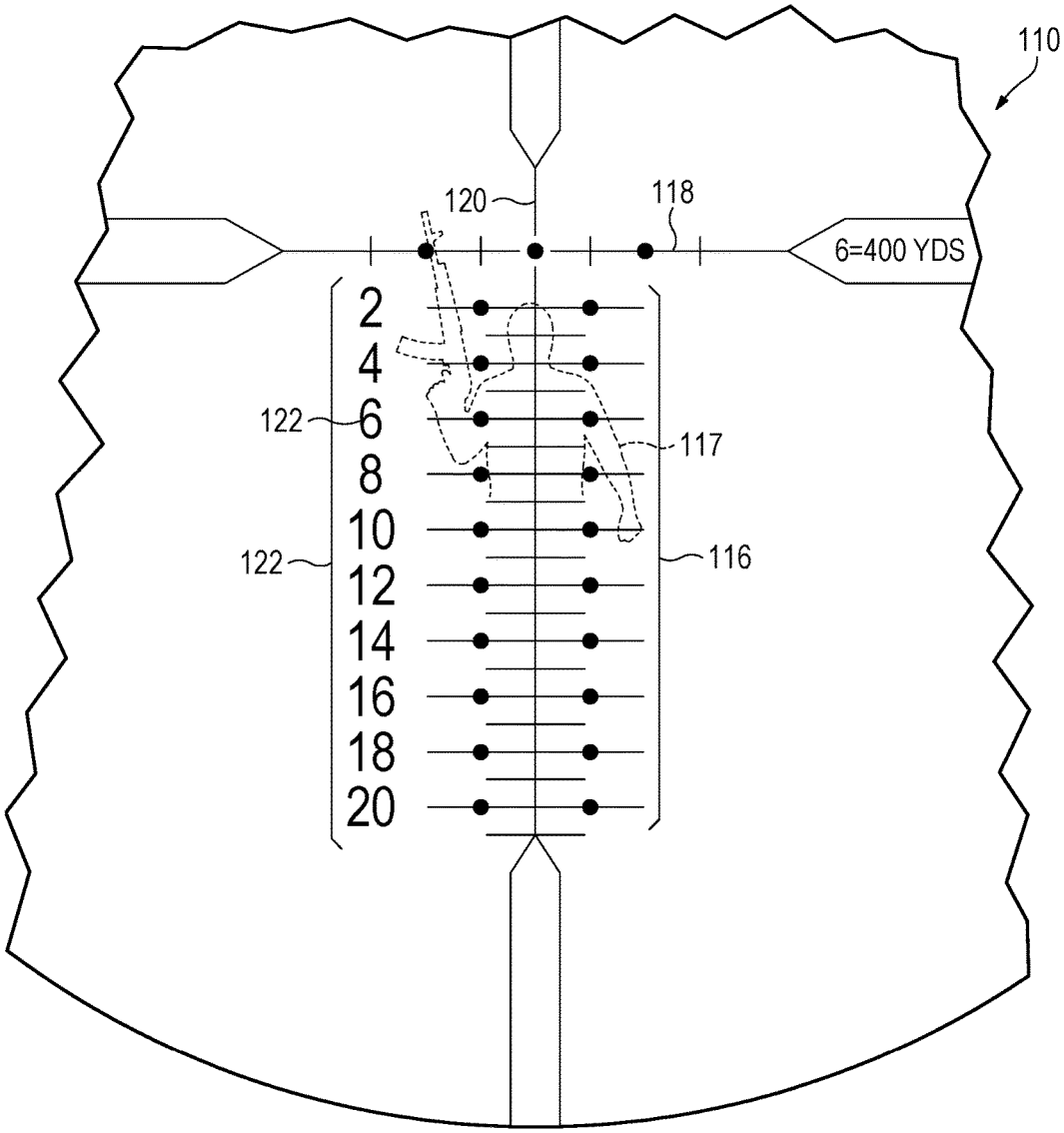
FIG. 4*d* is a view of the reticle aimed at the human figure as informed by the ranging of FIG. 4*c*.

Referring to FIG. 3 and FIG. 4*d*, a set of marks 116, below the horizontal line 118, in the embodiment shown taking the form of a set of lines, crossing a vertical line 120, but which could also be some other shape, and marked with indicia 122, that match indicia 114*a*. So, in the Black Tail Buck example presented above, the shooter places the mark 116 bearing the indicium "4" on the target, thereby lifting a rifle attached to the scope up by 4 minutes of angle, enough to compensate for the bullet drop to the target. In the Mule Deer example, the hunter would place the mark 116 bearing the "6" on the target. FIG. 4*d* shows the reticle being used to aim at the human FIG. 117, with the center of the line 116 that is marked with a "6" by an indicium 122, placed over the heart location of the FIG. 117, as was indicated by the ranging performed in FIG. 4*c*.

Figure 5:
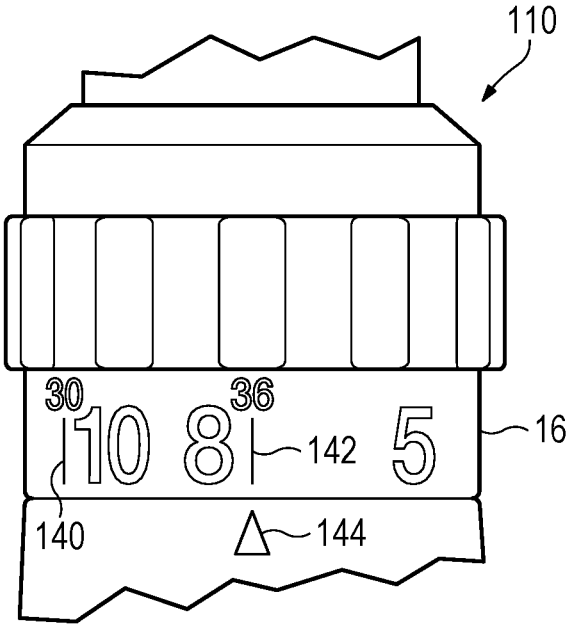
FIG. 5 is an isometric view of the zoom ring of the scope of FIG. 1.

Referring to FIG. 5, zoom selector ring 16 is marked with two marks 140 and 142, as shown "30" and "36," respectively. When the numeral 30 is chosen (the zoom selector ring 16 is moved so that the number is aligned with alignment mark 144, providing a lower level of magnification), and thereby calibrating the line "24" (FIGS. 3, 4*a*, 4*b*, 4*c*) as a "30" or "36" inch target size indicating line. Then the line 112*b* marked with a "24" can be used to range a larger target, that is 30" high. But if the numeral "36" is chosen, then the line 112*b* marked with a "24" can be used to range targets that are 36" vertically, for example a bull elk, in the same way that the same line can be used to range a cow elk when the zoom selector ring 16 is turned to "24". In the instance of using these lower magnification levels, the indicia of the marks 116 do not reflect the minutes of angle necessary to correct for bullet drop. Some hunters may be knowledgeable enough to correct for the lower magnification level in the use of marks 116. Alternatively, a hunter may turn the zoom selector ring 16 to the highest level of magnification, and then use marks 116, which will accurately compensate for the bullet drop determined in the previous step, or he can use the elevation knob 17 (FIGS. 1 and 2) to correct for bullet drop. If the reticle lens 14 (FIG. 2) is in the first focal plane, zoom adjustments do not affect the spacing of the reticle lines, relative to images in the field of view. The user may use marks 116 to compensate for bullet drop, or the elevation knob 17, informed by the minutes of angle markings of lines 112*a*.

Finally, in an additional feature, a legend 130 permits those using a laser range finder to quickly convert the range provided by the range finder to minutes of angle, which may then guide the usage of marks 116, in the pointing up of a fire arm that is attached to scope 10, to a degree that compensates for bullet drop, to the range of the target.

Generally speaking, a user may alter the position of horizontal line 118 relative to the boresight of the rifle, to compensate for the type of cartridge being used, according to well-known techniques.

While a number of exemplary aspects and embodiments have been discussed above, those possessed of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

The invention claimed is:

1. A rifle and rifle scope assembly, comprising:

(a) a rifle;

(b) a rifle scope housing, attached to said rifle, said housing defining an eyepiece;

(c) an optical train, in said housing;

(d) a reticle lens, in said optical train; and (e) wherein when a user looks through said eyepiece, said reticle lens presents a display having:

(i) a set of first horizontal lines, each marked by an indicium;

(ii) a set of second horizontal lines, each marked by an indicium;

(iii) a first one of said first horizontal lines and a first one of said second horizontal lines forming a first pair of lines, spaced apart by a distance that fits the distance on an adult black-tail buck from the top of the back to the brisket, as seen through said scope, if said buck is at a range that results in bullet drop of a first known amount;

(iv) wherein said first one of said first horizontal lines is labeled with a first indicium and said first one of said second horizontal lines marked with a second indicium indicating an aspect of an adult black-tail buck; and (v) further wherein a set of marks, includes a first mark which will, if placed on a target, result in an elevation angle, relative to said target, that will compensate for said first known amount of bullet drop, and wherein said first mark is also marked with said first indicium; and (f) whereby a user can determine that an adult black-tail buck fits said first pair of lines, from back to brisket, read said first indicium, find a mark marked with said first indicium, position said rifle so that when said user views said buck through said eyepiece, said mark is superimposed on said buck, and shoot, thereby quickly compensating for bullet drop at range to said buck.

2. The assembly of claim 1, wherein said aspect of an adult black-tail buck is the distance from the back to the brisket of an adult black-tail buck.

3. The assembly of claim 2, wherein said second indicia is said distance from the back to the brisket of an adult black-tail buck in inches, being the numeral "15".

4. The assembly of claim 1, wherein said aspect of an adult black-tail buck is a class of animals, in which a black-tail buck belongs.

5. The assembly of claim 1, wherein said indicia marking said first lines and said markings are numerals indicating units of angular measurement.

6. The assembly of claim 5, wherein said second lines are beneath said first lines and said indicia reflect the units of angular measurement derived from the distance from the top of said second line to the bottom of said first line.

7. The assembly of claim 5, wherein said units of angular measurement are minutes of angle.

8. The assembly of claim 1, wherein said reticle lens further includes a set of width indicators, each one marked with an indicator of elevation angle needed to overcome bullet drop to a range indicated by an 18" width target fitting the width indicator, in the same units as the markings of said first lines and said marks.

9. The assembly of claim 1, wherein a second one of said second horizontal lines and said first one of said first horizontal lines form a second pair of lines, spaced apart by a distance that matches the distance on an adult mule deer buck from the top of the back to the brisket, as seen through said scope, if said buck is at a range that results in bullet drop of said known amount.

10. The assembly of claim 9, wherein a third one of said second horizontal lines and said first one of said first horizontal lines form a third pair of lines, spaced apart by a distance that matches the distance on an adult cow elk from the top of the back to the brisket, as seen through said scope, if said buck is at a range that results in bullet drop of said known amount.

11. The assembly of claim 10, wherein said first, second and third second lines are marked with the numerals 15, 18 and 24, respectively.

12. The assembly of claim 9, wherein rifle scope includes a zoom mechanism that is controlled by a zoom knob to provide a controllable level of magnification, and wherein said zoom knob is set in a first position.

13. The assembly of claim 12, wherein said first position is marked with a first indicium.

14. The assembly of claim 13, wherein a second position on said knob is marked with a second indicium and wherein setting said knob to said second position results in one of said second lines, when paired with said first one of said first lines, forms a pair of lines that fits a bull elk from back to brisket when said bull elk is at a range to cause said first amount of bullet drop.

15. The assembly of claim 1, wherein a second one of first horizontal lines is marked with a second indicium, and wherein said first one of said second lines and said second one of said first lines forms a pair of lines spaced apart by a distance that fits the distance on an adult black tail buck from the top of the back to the brisket, as seen through said scope, if said buck is at a range that results in a bullet drop of a second known amount and wherein a second mark which will, if placed on a target, result in an elevation angle relative to said target, that will compensate for said second known amount of bullet drop, is also marked with said second indicium.

16. The assembly of claim 15, wherein a third one of first horizontal lines is marked with a third indicium, and wherein said first one of said second lines and said third one of said first lines forms a pair of lines spaced apart by a distance that fits the distance on an adult black tail buck from the top of the back to the brisket, as seen through said scope, if said buck is at a range that results in a bullet drop of a third known amount and wherein a third mark which will, if placed on a target, result in an elevation angle relative to said target, that will compensate for said third known amount of bullet drop, is also marked with said third indicium.

17. The assembly of claim 16, wherein a fourth one of first horizontal lines is marked with a fourth indicium, and wherein said first one of said second lines and said fourth one of said first lines forms a pair of lines spaced apart by a distance that fits the distance on an adult black tail buck from the top of the back to the brisket, as seen through said scope, if said buck is at a range that results in a bullet drop of a fourth known amount and wherein a fourth mark which will, if placed on a target, result in an elevation angle relative to said target, that will compensate for said fourth known amount of bullet drop, is also marked with said fourth indicium.

18. The assembly of claim 17, wherein said first, second, third and fourth indicium are all minutes of angle, of elevation angle, necessary to compensate for said first, second, third and fourth amounts of bullet drop, respectively.

19. The assembly of claim 18, wherein said first, second, third and fourth indicium are 3, 4, 5 and 6.

20. The assembly of claim 1, further including a set of third horizontal lines, having differing lengths, and each being marked with an indicium, and wherein a first one of said third horizontal lines is marked with said first indicium, and wherein when said first one of said third horizontal lines matches the width of a man from shoulder to shoulder, this is an indication that the man is at said range that results in a bullet drop of said first known amount.

* * * * *